US007983591B2

(12) United States Patent
Yamada

(10) Patent No.: US 7,983,591 B2
(45) Date of Patent: Jul. 19, 2011

(54) IMAGE FORMING APPARATUS METHOD FOR REMOVING TONER FROM SEAL MEMBER BY ROTATION OF TONER CARRIER ROLLER

(75) Inventor: Yoichi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 409 days.

(21) Appl. No.: 12/254,166

(22) Filed: Oct. 20, 2008

(65) Prior Publication Data

US 2009/0110428 A1 Apr. 30, 2009

(30) Foreign Application Priority Data

Oct. 29, 2007 (JP) ..... 2007-279840

(51) Int. Cl.
*G03G 15/08* (2006.01)

(52) U.S. Cl. ..... 399/102; 399/103

(58) Field of Classification Search ..... 399/102, 399/103

See application file for complete search history.

(56) References Cited

U.S. PATENT DOCUMENTS

| | | | | |
|---|---|---|---|---|
| 6,144,820 | A | 11/2000 | Ishii et al. | |
| 2007/0110481 | A1 | 5/2007 | Yamada et al. | |
| 2007/0206973 | A1 * | 9/2007 | Yamada et al. | 399/226 |
| 2007/0212088 | A1 * | 9/2007 | Koike et al. | 399/55 |

FOREIGN PATENT DOCUMENTS

| | | | |
|---|---|---|---|
| JP | 07175394 | A * | 7/1995 |
| JP | 2003131478 | A * | 5/2003 |
| JP | 2007-121948 | A | 5/2007 |
| JP | 2007133244 | A | 5/2007 |
| JP | 2007-140080 | A | 6/2007 |
| JP | 2007147853 | A | 6/2007 |

OTHER PUBLICATIONS

European search report for corresponding European application 08018815.4-2209 lists the references above.

* cited by examiner

*Primary Examiner* — David M Gray
*Assistant Examiner* — G. M. Hyder
(74) *Attorney, Agent, or Firm* — DLA Piper LLP (US)

(57) ABSTRACT

An image forming apparatus, includes: an image carrier that carries an electrostatic latent image; a toner carrier roller that is provided, on a surface thereof, with a plurality of convex sections and a concave section which surrounds the convex sections, is shaped approximately like a cylinder, is arranged opposed to the image carrier, and rotates while carrying a toner layer of charged toner on the surface thereof; a bias applier that applies a developing bias voltage to the toner carrier roller; a toner collector that collects the toner carried on the surface of the toner carrier roller at a place downstream to an opposed position facing the image carrier in a rotation direction of the toner carrier roller; a seal member that is interposed between the toner carrier roller and the toner collector, and abuts on the surface of the toner carrier roller to prevent leakage of toner from the toner collector; and a controller that is adapted to perform a toner removal operation which removes toner adherent to the seal member by rotating the toner carrier roller while the toner carrier roller abuts on the seal member, in a condition that at least a part of respective surfaces of the convex sections do not carry toner so as to be exposed.

11 Claims, 13 Drawing Sheets

IMAGE FORMING APPARATUS METHOD FOR REMOVING TONER FROM SEAL MEMBER BY ROTATION OF TONER CARRIER ROLLER

CROSS REFERENCE TO RELATED APPLICATION

The disclosure of Japanese Patent Application No. 2007-279840 filed on Oct. 29, 2007 including specification, drawings and claims is incorporated herein by reference in its entirety.

BACKGROUND

1. Technical Field

The present invention relates to an image forming apparatus which comprises a toner carrier roller which carries toner on a surface thereof and an image forming method of developing an electrostatic latent image with toner using this roller.

2. Related Art

In techniques for developing an electrostatic latent image carried on an image carrier with toner, an apparatus is widely used which includes a toner carrier roller which is shaped approximately like a cylinder, carries toner on a surface thereof, and is arranged opposed facing the image carrier. For the purpose of improving the characteristics of toner carried on the surface of such a toner carrier roller, the applicant of the present application has earlier disclosed a structure of a toner carrier roller having a cylindrical shape that the surface of the roller includes convex sections which are regularly arranged and a concave section which surrounds the convex sections (JP-A-2007-121948). Since the concavo-convex patterns in the surface are regulated and uniform, such a structure is advantageous in that it permits easy control of the thickness of a toner layer which is carried on the surface of the roller, the charge level and the like.

In the image forming apparatus structured as above, toner that is not used for development at the opposed position facing the image carrier and remains on the toner carrier roller is collected in a developer, and the developer is provided with a seal member which is made of a polyethylene film or the like and abuts on the surface of the toner carrier roller in order to prevent toner inside the developer from leaking outside.

SUMMARY

At an abutting position at which the toner carrier roller and the seal member are in abutting contact, the toner carried on the surface of the toner carrier roller inevitably becomes adherent to the seal member. The toner thus adhered to the seal member may clump together to form a large agglomerate or may melt due to heat generated by friction with the toner carrier roller to be fixed to the seal member. As a result, problems may arise that the toner agglomerate may enter the developer and may be caught on a restriction blade to cause a streaky image defect, and that the fixed toner may be transferred to the toner carrier roller to cause filming. Even if it does not go so far as to entail the above problems, the toner fixed to the seal member has sometimes caused charge variation and the like of the toner on the toner carrier roller, which has resulted in a streaky image defect. Particularly, lowering a melting point of toner, increase of contained amount of wax and the like associated with lowering the fixing temperature demanded in recent years increase occurrence frequency of the fixing of toner. Furthermore, reduction of the particle diameter of toner for achieving higher image quality increases van der Waals' force exerted on the toner, which makes fixing and agglomeration of toner easy to occur. Hence, the problems above have become more serious.

In a case where the toner carrier roller which is provided with the concavo-convex on its surface as described above is used, since the toner carried on the convex sections is subjected to a strong pressing force in particular, such fixing of toner to the seal member is likely to occur.

An advantage of some aspects of the invention is to provide a technique to resolve the problems of fixing of toner to the seal member, and filming, image defect and the like resulting from the fixing of toner, in the image forming apparatus and method which use the toner carrier roller provided with the concavo-convex on its surface.

According to a first aspect of the invention, there is provided an image forming apparatus, comprising: an image carrier that carries an electrostatic latent image; a toner carrier roller that is provided, on a surface thereof, with a plurality of convex sections and a concave section which surrounds the convex sections, is shaped approximately like a cylinder, is arranged opposed to the image carrier, and rotates while carrying a toner layer of charged toner on the surface thereof, a bias applier that applies a developing bias voltage to the toner carrier roller; a toner collector that collects the toner carried on the surface of the toner carrier roller at a place downstream to an opposed position facing the image carrier in a rotation direction of the toner carrier roller; a seal member that is interposed between the toner carrier roller and the toner collector, and abuts on the surface of the toner carrier roller to prevent leakage of toner from the toner collector; and a controller that is adapted to perform a toner removal operation which removes toner adherent to the seal member by rotating the toner carrier roller while the toner carrier roller abuts on the seal member, in a condition that at least a part of respective surfaces of the convex sections do not carry toner so as to be exposed.

According to a second aspect of the invention, there is provided an image forming method, comprising: performing an image forming operation that includes: rotating a toner carrier roller that is provided, on a surface thereof, with a plurality of convex sections and a concave section which surrounds the convex sections, is shaped approximately like a cylinder, and carries a toner layer of charged toner on the surface thereof to transport the toner layer to an opposed position facing an image carrier which carries an electrostatic latent image; developing the electrostatic latent image with the toner; and collecting toner carried on the surface of the toner carrier roller by causing a seal member to abut on the surface of the toner carrier roller at a place downstream to the opposed position facing the image carrier in a rotation direction of the toner carrier roller, and performing a toner removal operation which removes toner adherent to the seal member by rotating the toner carrier roller while the toner carrier roller abuts on the seal member, in a condition that at least a part of the respective surfaces of the convex sections do not carry toner, wherein the image forming operation and the toner removal operation are selectively performed.

According to an aspect of the invention structured as described above, the toner fixed to the seal member can be removed by performing a toner removal operation. In rotating the toner carrier roller, when the toner carrier roller abuts on the seal member with the convex sections within the surface thereof being totally covered with toner, the toner sandwiched between the convex sections and the seal member is compacted and fixed to the seal member and the convex sections. On the other hand, when the toner carrier roller is rotated while abutting on the seal member in a condition that at least a part of surfaces of the convex sections do not carry toner so as to be exposed, the convex sections make a friction contact with the toner fixed to the seal member, which makes it possible to scrape off the toner. Thus, in the invention, toner fixed to the seal member is removed by performing the toner removal operation. Hence, it is possible to prevent the image defects and filming due to the fixed toner. Further, since the toner carrier roller is provided with concavoconvex structure, the toner can be scraped off efficiently.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

Figure 1:
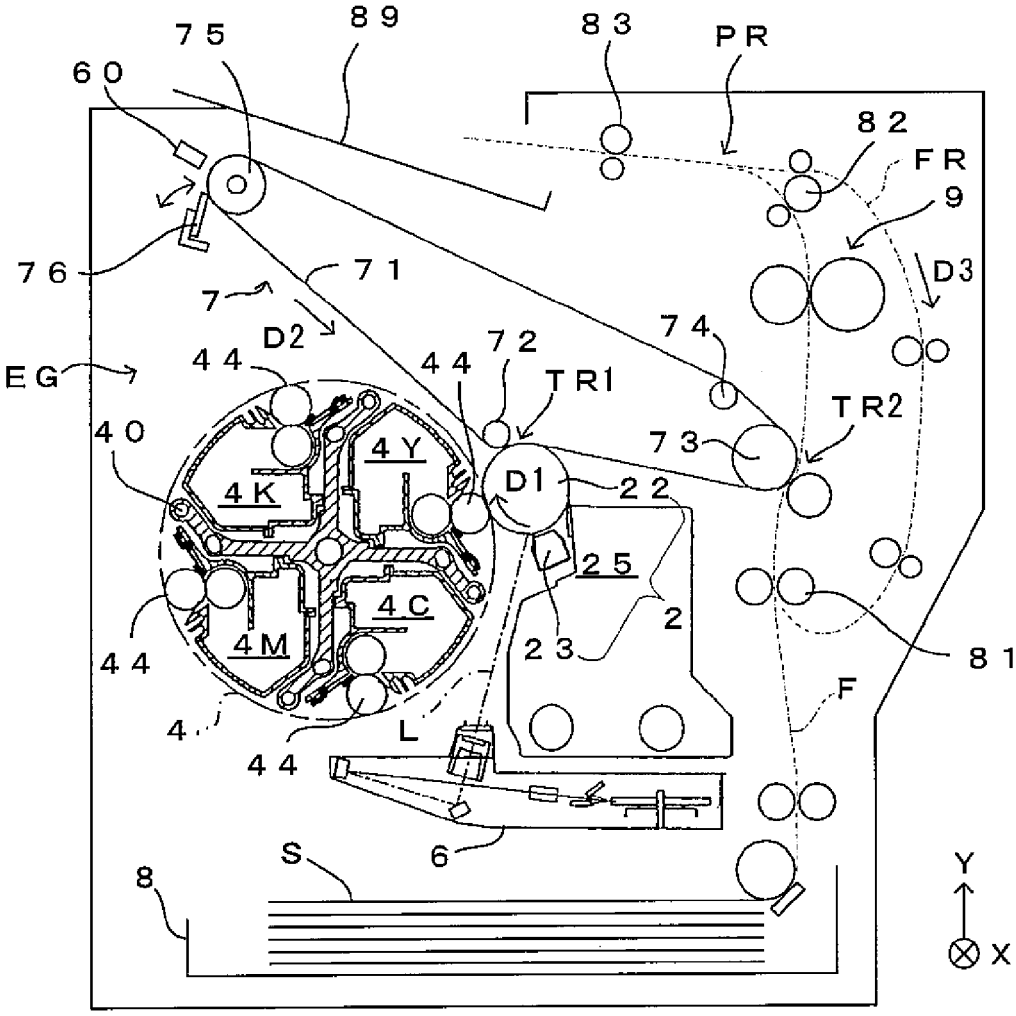
FIG. 1 is a diagram showing a first embodiment of an image forming apparatus according to the invention.
Figure 2:
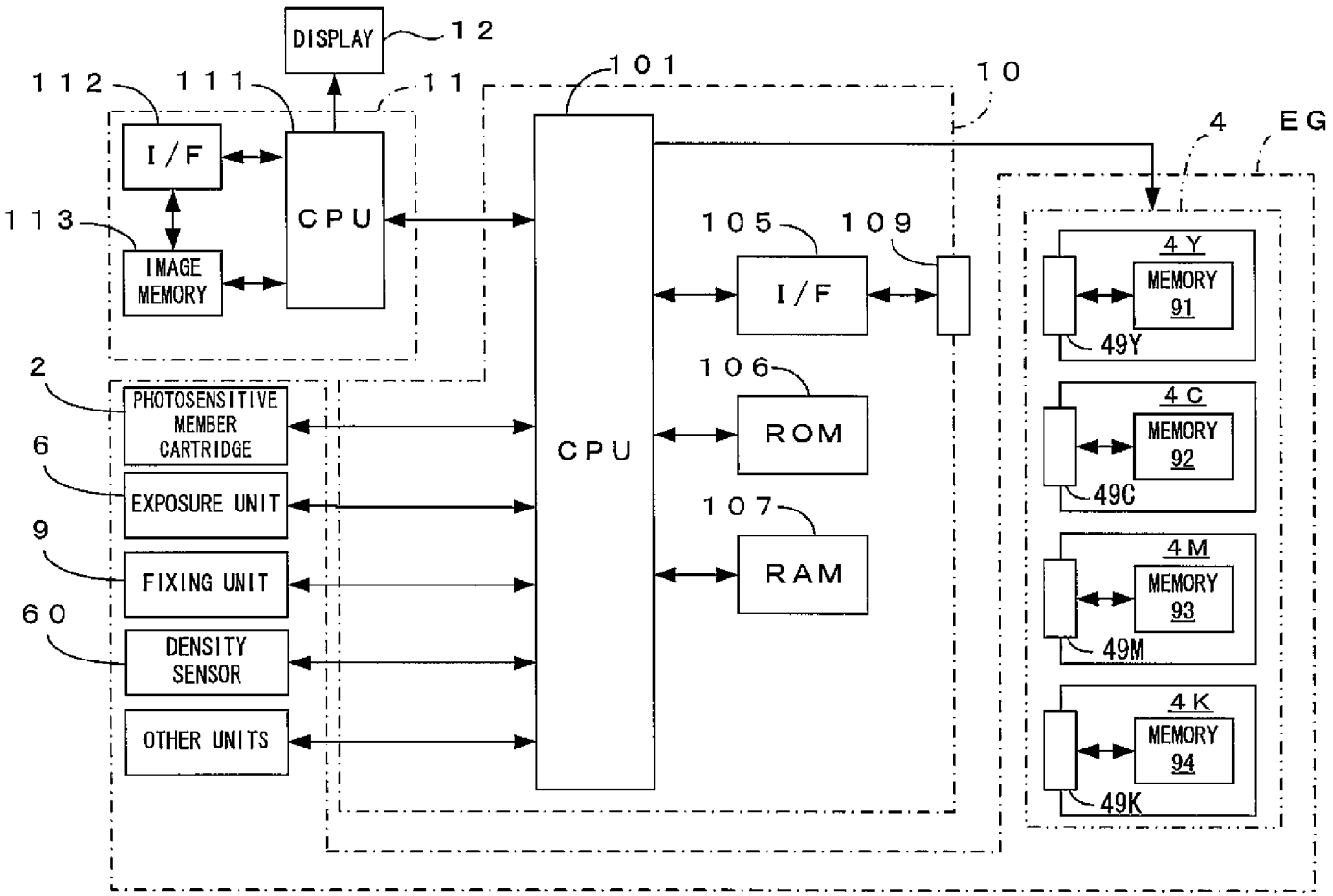
FIG. 2 is a block diagram of an electric structure of the image forming apparatus which is shown in FIG. 1.

FIG. 1 is a diagram showing a first embodiment of an image forming apparatus according to the invention. FIG. 2 is a block diagram of an electric structure of the image forming apparatus which is shown in FIG. 1. This apparatus is an image forming apparatus which overlays toner in four colors of yellow (Y), cyan (C), magenta (M) and black (K) one atop the other and accordingly forms a full-color image, or forms a monochrome image using only black toner (K). In the image forming apparatus, when an image signal is fed to a main controller 11 from an external apparatus such as a host computer, a CPU 101 provided in an engine controller 10 controls respective portions of an engine part EG in accordance with an instruction received from the main controller 11 to perform a predetermined image forming operation, and accordingly, an image which corresponds to the image signal is formed on a sheet S.

In the engine part EG, a photosensitive member 22 is disposed so that the photosensitive member 22 can freely rotate in an arrow direction D1 shown in FIG. 1. Around the photosensitive member 22, a charger unit 23, a rotary developer unit 4 and a cleaner 25 are disposed in the rotation direction D1. A predetermined charging bias is applied upon the charger unit 23, whereby an outer circumferential surface of the photosensitive member 22 is charged uniformly to a predetermined surface potential. The cleaner 25 removes toner which remains adhering to the surface of the photosensitive member 22 after primary transfer, and collects the toner into a waste toner tank which is disposed inside the cleaner 25. The photosensitive member 22, the charger unit 23 and the cleaner 25, integrated as one, form a photosensitive member cartridge 2. The photosensitive member cartridge 2 can be freely attached to and detached from an apparatus main body as one integrated unit.

An exposure unit 6 emits a light beam L toward the outer circumferential surface of the photosensitive member 22 charged by the charger unit 23. This exposure unit 6 exposes the photosensitive member 22 by the light beam L in accordance with the image signal given from the external apparatus to form an electrostatic latent image corresponding to the image signal.

The developer unit 4 develops thus formed electrostatic latent image with toner. Specifically, the developer unit 4 includes a support frame 40 which is provided rotatable about a rotation shaft orthogonal to a plane of FIG. 1 and a yellow developer 4Y, a cyan developer 4C, a magenta developer 4M and a black developer 4K which are freely attachable to and detachable from the support frame 40 and house toner of the respective colors. An engine controller 10 controls the developer unit 4. The developer unit 4 is driven into rotation based on a control instruction from the engine controller 10. When the developers 4Y, 4C, 4M and 4K are selectively positioned at a predetermined developing position which is faced with the photosensitive member 22 over a predetermined gap, the developing roller 44 which is disposed in this developer and carries a toner of a selected color is positioned facing the photosensitive member 22, and the developing roller 44 supplies the toner onto the surface of the photosensitive member 22 at the facing position. As a result, the electrostatic latent image on the photosensitive member 22 is visualized with the toner of the selected color.

Figure 3:
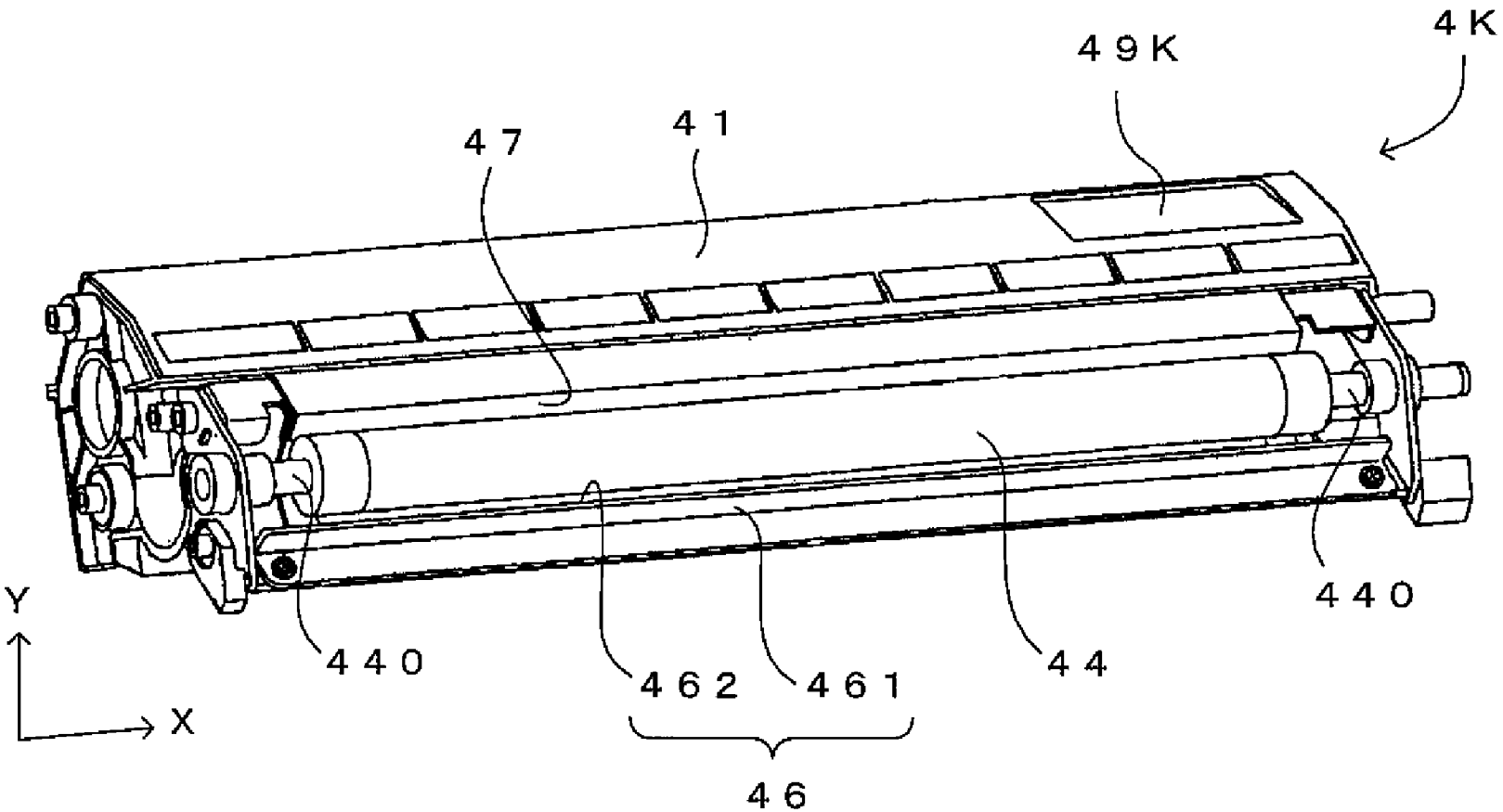
FIG. 3 is a diagram showing the appearance of the developer.
Figure 4A:
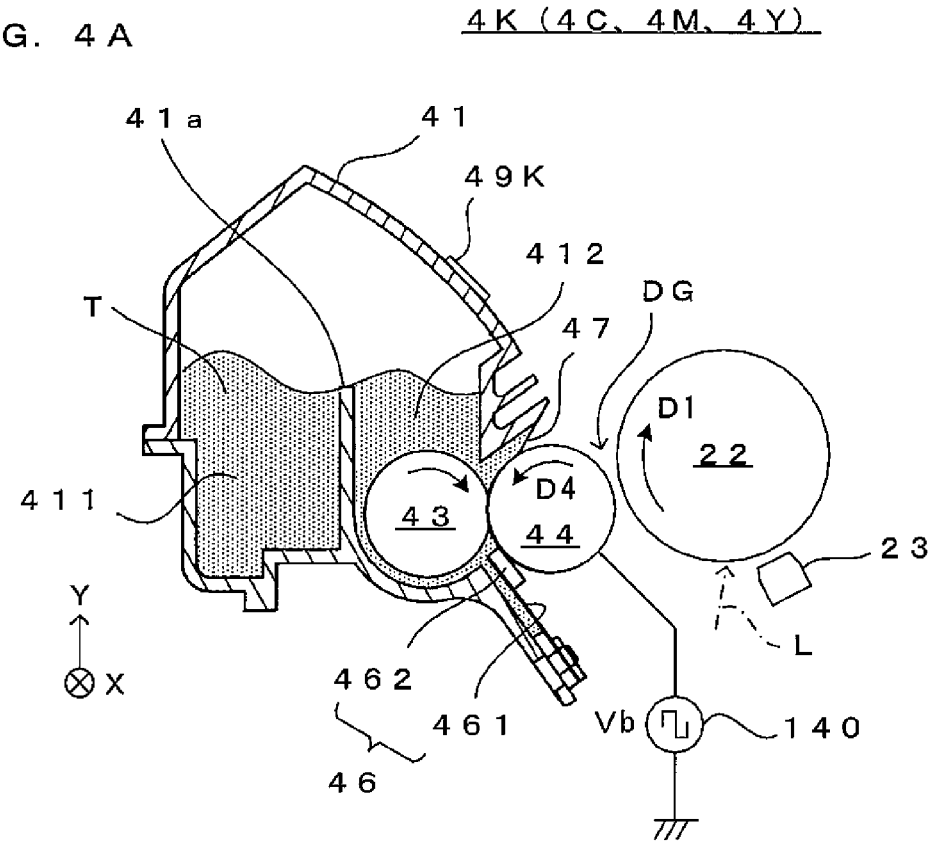
FIG. 4A is a cross sectional view showing a structure of the developer.
Figure 4B:
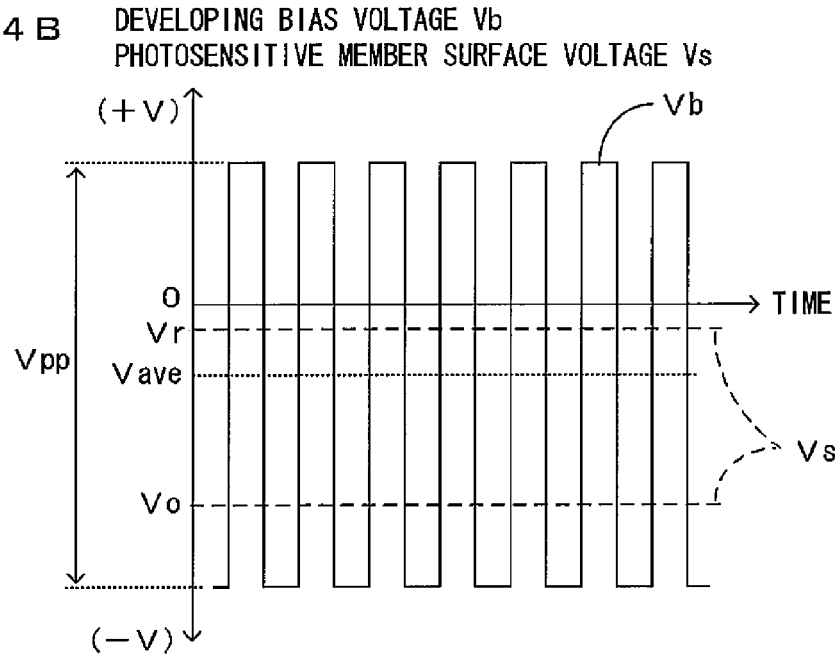
FIG. 4B is a graph showing the relationship between a waveform of a developing bias and a surface potential of the photosensitive member.

FIG. 3 is a diagram showing the appearance of the developer. FIG. 4A is a cross sectional view showing a structure of the developer, and FIG. 4B is a graph showing the relationship between a waveform of a developing bias and a surface potential of the photosensitive member. The developers 4Y, 4C, 4M and 4K have identical structures. Therefore, the structure of the developer 4K will now be described in further detail with reference to FIGS. 3 and 4A. The other developers 4Y, 4C and 4M have the same structures and functions, to be noted.

In the developer 4K, a feed roller 43 and a developing roller 44 are rotatably attached with a shaft to a housing 41 which houses monocomponent toner T inside. When the developer 4K is positioned at the developing position described above, the developing roller 44 is positioned at a facing position which is faced with the photosensitive member 22 over a developing gap DG, and these rollers 43 and 44 are engaged with a rotation driver (not shown) which is provided in the main body to rotate in a predetermined direction. The feed roller 43 is shaped like a cylinder and is made of an elastic material such as foamed urethane rubber and silicone rubber. The developing roller 44 is shaped like a cylinder and is made of metal or alloy such as copper, aluminum and stainless steel. The two rollers 43 and 44 rotate while staying in contact with each other, and accordingly, the toner is rubbed against the surface of the developing roller 44 and a toner layer having a predetermined thickness is formed on the surface of the developing roller 44. Although negatively-charged toner is used in this embodiment, positively-charged toner may be used instead.

The space inside the housing 41 is divided by a partition wall 41*a* into a first chamber 411 and a second chamber 412. The feed roller 43 and the developing roller 44 are both provided in the second chamber 412. With a rotation of these rollers, toner within the second chamber 412 flows and is fed to the surface of the developing roller 44 while getting agitated. Meanwhile toner stored inside the first chamber 411 would not be moved by the rotation since it is isolated from the feed roller 43 and the developing roller 44. This toner is mixed with toner stored in the second chamber 412 and is agitated by the rotation of the developer unit 4 while holding the developer.

As described above, in this developer, the inside of the housing is separated into the two chambers, and the side walls of the housing 41 and the partition wall 41*a* surround the feed roller 43 and the developing roller 44, and accordingly, the second chamber 412 of relatively small volume is provided. Therefore, even when a remaining toner amount is small, toner is supplied efficiently to near the developing roller 44. Further, supply of toner from the first chamber 411 to the second chamber 412 and agitation of the whole toner are performed by the rotation of the developer unit 4. Hence, an auger-less structure is realized that an agitator member (auger) for agitating toner is not provided inside the developer.

Further, in the developer 4K, a restriction blade 46 is disposed which restricts the thickness of the toner layer formed on the surface of the developing roller 44 into the predetermined thickness. The restriction blade 46 includes a plate-like member 461 made of elastic material such as stainless steel, phosphor bronze or the like and an elastic member 462 which is attached to a front edge of the plate-like member 461 and is made of a resin member such as silicone rubber and a urethane rubber. A rear edge of the plate-like member 461 is fixed to the housing 41. The elastic member 462 attached to the front edge of the plate-like member 461 is positioned on the upstream side to the rear edge of the plate-like member 461 in a rotation direction D4 of the developing roller 44 shown by an arrow in FIG. 4. The elastic member 462 elastically abuts on the surface of the developing roller 44 to form a restriction nip, thereby restricting the toner layer formed on the surface of the developing roller 44 finally into the predetermined thickness.

The toner layers thus formed on the surface of the developing roller 44 are transported, by means of the rotation of the developing roller 44, one after another to the opposed positions against the photosensitive member 22 on the surface of which an electrostatic latent image is formed. The developing bias from a bias power source 140 controlled by the engine controller 10 is applied to the developing roller 44. As shown in FIG. 4B, a surface potential Vs of the photosensitive member 22 drops down approximately to a residual potential Vr at exposed segments exposed by the light beam L from the exposure unit 6 after getting uniformly charged by the charger unit 23, but stays at an almost uniform potential V0 at non-exposed segments not exposed by the light beam L. Meanwhile, the developing bias Vb applied to the developing roller 44 is rectangular-wave AC voltage on which a DC potential Vave is superimposed, and its peak-to-peak voltage will be hereinafter denoted at Vpp. With application of such a developing bias Vb, toner carried on the developing roller 44 is made jump across a developing gap DG and partially adheres to the respective sections in the surface of the photosensitive member 22 in accordance with the surface potential Vs of the photosensitive member 22, whereby an electrostatic latent image on the photosensitive member 22 is visualized as a toner image in the color of the toner.

A rectangular-wave voltage having a peak-to-peak voltage of 1500V and a frequency of about 3 kHz, for example, may be used as the developing bias voltage Vb. Since an electric potential difference between the direct current component Vave of the developing bias voltage Vb and a residual potential Vr of the photosensitive member 22 constitutes a so-called development contrast which affects image density, the direct current component Vave may be set to a required value for obtaining a predetermined image density.

The housing 41 further includes a seal member 47 which is pressed against the surface of the developing roller 44 on the downstream side to the opposed position facing the photosensitive member 22 in the rotation direction of the developing roller 44. The seal member 47 is a belt-like film made of a flexible material such as polyethylene, nylon or fluororesin extending in a direction X parallel to a rotational axis of the developing roller 44. One end of the seal member 47 in a direction Y perpendicular to the direction X is fixed to the housing 41, and the other end of the seal member 47 abuts on the surface of the developing roller 44. The other end of the seal member 47 is allowed to abut on the developing roller 44 as directed toward the downstream side in the rotation direction D4 of the developing roller 44, or directed in a so-called trail direction. The other end of the seal member 47 guides toner which remains on the surface of the developing roller 44 after moving past the opposed position facing the photosensitive member 22 to inside the housing 41 and prevents toner inside the housing from leaking to outside.

Figure 5:
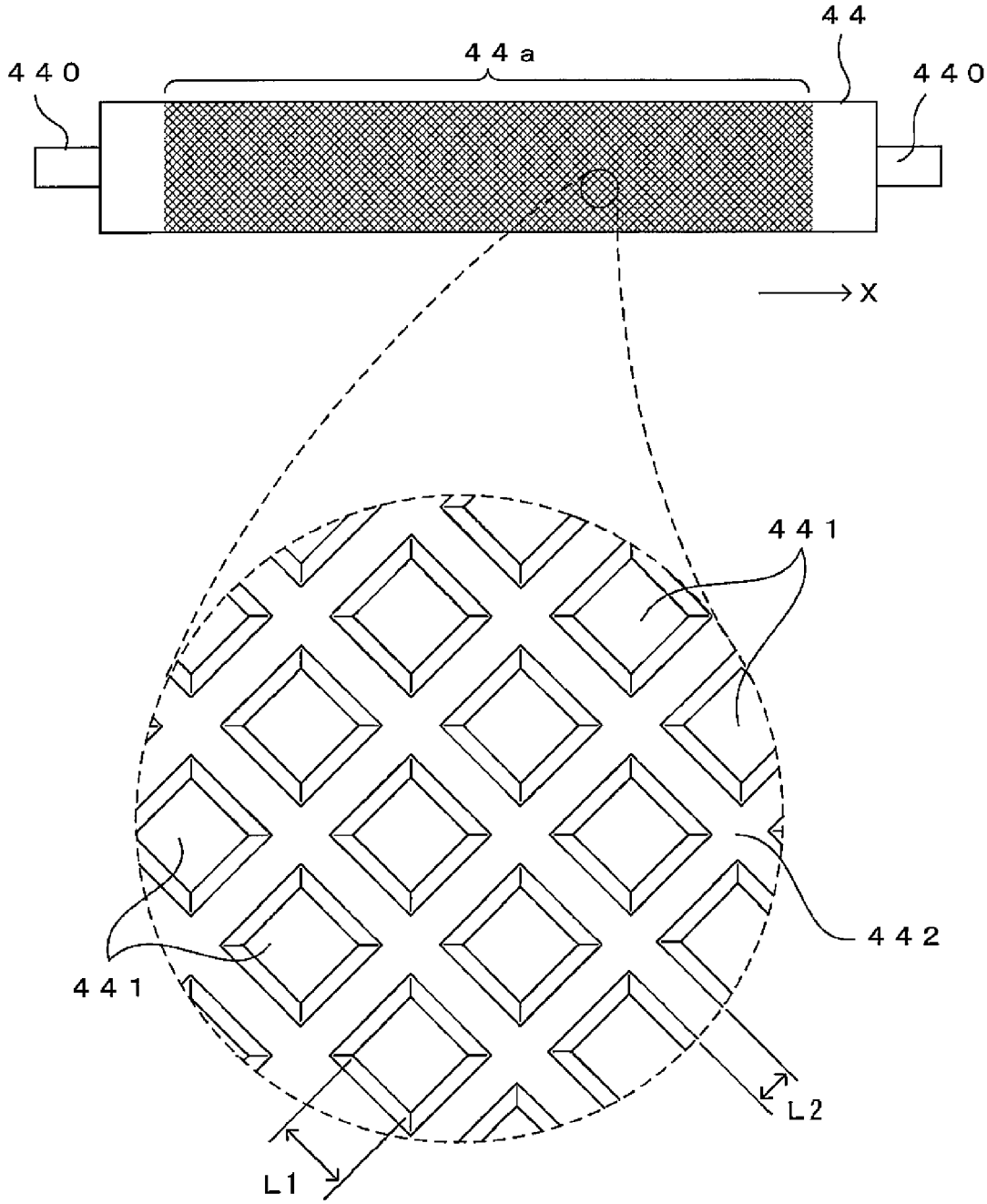
FIG. 5 is a group of diagrams showing a side view of the developing roller and a partially expanded view of the surface of the developing roller.

FIG. 5 is a group of diagrams showing a side view of the developing roller and a partially expanded view of the surface of the developing roller. The developing roller 44 is shaped like an approximately cylindrical roller. A shaft 440 is provided at the both ends of the roller in the longitudinal direction of the roller such that the shaft is coaxial with the roller. With the shaft 440 supported by the developer main body, the entire developing roller 44 is freely rotatable. A central area 44*a* in the surface of the developing roller 44, as shown in the partially expanded view in FIG. 5 (inside the dotted-line circle), is provided with a plurality of convex sections 441 which are regularly arranged and a concave section 442 which surrounds the convex sections 441.

Each one of the convex sections 441 projects forward from the plane of FIG. 5, and a top surface of each convex section 441 forms a part of a single cylindrical surface which is coaxial with a rotation shaft of the developing roller 44. The concave section 442 is a continuous groove which surrounds the convex sections 441 like a net. The entire concave section 442 also forms a single cylindrical surface which is different from the cylindrical surface which is made by the convex sections and is coaxial with the rotation shaft of the developing roller 44. The developing roller 44 having such a structure may be made by the manufacturing method described in JP-A-2007-140080 for instance.

The length L1 of a side of the top surface of each convex section 441 and a distance L2 between the respective convex sections are preferably larger than a particle diameter of toner and may be but are not limited to 10 through 100 μm approximately for instance. The shape, the arrangement and the like of the convex sections 441 are not limited to those described here.

Referring back to FIG. 1, the description of the image forming apparatus is continued. The toner image developed by the developer unit 4 as described above is primarily transferred onto an intermediate transfer belt 71 of a transfer unit 7 in a primary transfer region TR1. The transfer unit 7 includes the intermediate transfer belt 71 mounted on a plurality of rollers 72 to 75 and a driver (not shown) for driving the roller 73 into rotation to rotate the intermediate transfer belt 71 in a specified rotating direction D2. In the case of transferring a color image onto the sheet S, the toner images of the respective colors formed on the photosensitive member 22 are superimposed on the intermediate transfer belt 71 to form the color image, which is secondarily transferred onto the sheet S dispensed one by one from a cassette 8 and conveyed to a secondary transfer region TIC along a conveyance path F.

At this time, for the purpose of correctly transferring the image on the intermediate transfer belt 71 onto the sheet S at a predetermined position, the timing of feeding the sheet S into the secondary transfer region TR2 is controlled. To be more specific, there is a gate roller 81 disposed in front of the secondary transfer region TR2 on the transportation path F. The gate roller 81 starts to rotate in accordance with the timing of rotation of the intermediate transfer belt 71, and accordingly, the sheet S is fed into the secondary transfer region TR2 at a predetermined timing.

Further, the sheet S on which the color image is thus formed is transported to a discharge tray 89 which is disposed at a top surface of the apparatus main body via a pre-discharge roller 82 and a discharge roller 83 after the toner image is fixed to the sheet S by a fixing unit 9. Meanwhile, when images are to be formed on the both surfaces of the sheet S, the discharge roller 83 starts rotating in the reverse direction upon arrival of the rear end of the sheet S, which carries the image on its one surface as described above, at a reversing position PR located behind the pre-discharge roller 82, thereby transporting the sheet S in the arrow direction D3 along a reverse transportation path FR. The sheet S is returned back to the transportation path F again before arriving at the gate roller 81. At this time, the surface of the sheet S which abuts on the intermediate transfer belt 71 in the secondary transfer region TR2 and is to receive a transferred image is opposite to the surface which already carries the image. In this fashion, it is possible to form images on the both surfaces of the sheet S.

Further, as shown in FIG. 2, the respective developers 4Y, 4C, 4M and 4K comprise memories 91, 92, 93 and 94 respectively which store data related to the production lot, the use history, the remaining toner amount and the like of the developers. In addition, wireless telecommunication devices 49Y, 49C, 49M and 49K are provided in the developers 4Y, 4C, 4M and 4K, respectively. When necessary, the telecommunication devices selectively perform non-contact data telecommunication with a wireless telecommunication device 109 which is provided in the apparatus main body, whereby data transmission between the CPU 101 and the memories 91 through 94 via the interface 105 is performed to manage various types of information regarding the developers such as management of consumables. Meanwhile, in this embodiment, non-contact data transmission using electromagnetic scheme such as wireless telecommunication is performed. However, the apparatus main body and each developer may be provided with connectors and the like, and the connectors may be engaged mechanically to perform data transmission between each other.

Further, as shown in FIG. 2, the apparatus includes a display 12 which is controlled by a CPU 111 of the main controller 11. The display 12 is formed by a liquid crystal display for instance, and shows predetermined messages which are indicative of operation guidance for a user, a progress in the image forming operation, abnormality in the apparatus, the timing of exchanging any one of the units, and the like in accordance with the control command from the CPU 111.

In FIG. 2, a reference numeral 113 represents an image memory provided in the main controller 11 in order to store the image supplied from the external apparatus, such as a host computer, via the interface 112. A reference numeral 106 represents a ROM for storage of an operation program executed by the CPU 101 and control data used for controlling the engine EG. A reference numeral 107 represents a RAM for temporary storage of operation results given by the CPU 101 and other data.

Further, there is a cleaner 76 in the vicinity of the roller 75. The cleaner 76 moves nearer to and away from the roller 75 driven by an electromagnetic clutch not shown. In a condition that the cleaner 76 is moved nearer to the roller 75, a blade of the cleaner 76 abuts on the surface of the intermediate transfer belt 71 mounted on the roller 75 and scrapes off the toner remaining on and adhering to the outer circumferential surface of the intermediate transfer belt 71 after the secondary transfer.

Furthermore, a density sensor 60 is disposed in the vicinity of the roller 75. The density sensor 60 confronts a surface of the intermediate transfer belt 71 and measures, as needed, the density of the toner image formed on the outer circumferential surface of the intermediate transfer belt 71. Based on the measurement results, the apparatus adjusts the operating conditions of the individual parts thereof that affects the image quality such as a developing bias applied to each developer, the intensity of the exposure beam L, and tone-correction characteristics of the apparatus, for example.

The density sensor 60 is structured to output a signal corresponding to a contrasting density of a region of a predetermined area defined on the intermediate transfer belt 71 using a reflective optical sensor, for example. The CPU 101 is adapted to detect image densities of individual parts of the toner image on the intermediate transfer belt 71 by periodically sampling the output signals from the density sensor 60 while moving the intermediate transfer belt 71 in rotation.

Restriction of a toner layer on the developing roller 44 within the developer 4K, . . . of the image forming apparatus having the structure above will now be described in detail. In a structure as that described above in which the surface of the developing roller 44 for carrying toner has concavity and convexity, it is possible for both the convex sections 441 and the concave section 442 of the developing roller 44 to carry toner. However, in this embodiment, it is structured that the restriction blade 46 abuts on the developing roller 44 within the surface of the developing roller 44 directly to remove toner on the convex sections 441. The reason is as described below.

First, the distance between the restriction blade 46 and the convex sections 441 needs be controlled precisely in order to form a uniform toner layer on the convex sections 441. However, for carrying of toner only by the concave section 442, the restriction blade 46 may abut on the convex sections 441 and remove all toner on the convex sections 441, which can be realized relatively easily. Further, since the volume of the space defined between the restriction blade 46 and the concave section 442 determines the amount of transported toner, it is possible to stabilize a transported toner amount.

This provides another advantage with respect to superiority of a transported toner layer. That is, carrying of toner by the convex sections 441 tends to degrade toner because of friction contact of the toner with the restriction blade 46. More specifically, there are problems such as reduction of the fluidity and the charging performance of toner, clumping together due to toner particles pressed to each other, and filming due to fixedly adherence of toner to the developing roller 44. In contrast, carrying of toner by the concave section 442 which is less influenced by the pressure from the restriction blade 46 is less likely to give rise to such problems. Further, the manner of friction contact on the restriction blade 46 is greatly different between toner carried by the convex sections 441 and toner carried by the concave section 442. Hence, their charge levels are predicted to largely vary from each other. However, carrying of toner by the concave section 442 alone makes it possible to suppress such variations.

The recent years in particular have seen a growing demand for size reduction of toner particles and a lower fixing temperature to enhance the resolution of an image and reduce the amount of consumed toner and electric power consumption. The structure in this embodiment meets the demand. Small-particle toner generally has a high saturation charge level but gets charged slowly at the beginning, and hence, of toner carried by the convex sections 441, a portion which has not contributed to previous development has an increased charge level. On the other hand, new toner held inside the developer is fed onto the developing roller 44 in a part which carried toner that has contributed to previous development. However, since the new toner is charged up slowly at the beginning, its charge level will not immediately reach the charge level of the other part of toner.

The presence of segments having different toner charge levels on the developing roller 44 leads to local image density variations (the development history, the memory phenomenon), density variations corresponding to the rotation cycle of the developing roller 44 during formation of a solid image for instance. The workload is increased through adjustment of the rotation frequency and the pressure force of the feed roller 43 and the reset performance of the feed roller 43 is enhanced, and accordingly, such a phenomenon is beginning to be improved. However, this causes different problems that the drive torque of the developing roller 44 increases and toner degrades faster. With respect to toner having a low melting point, fixing of toner to each other and fixing of the toner to the developing roller 44 and the like could occur by the friction contact of toner with each other and with the developing roller 44. However, such a problem is less likely to occur where the structure according to the embodiment is used in which only the concave section 442 carries toner.

Meanwhile, removal of toner from the convex sections 441 reduces the transported toner amount transported by the developing roller 44 as a whole. This gives rise to other problem that a discharge inception voltage decreases in the developing gap DG. Specifically, the convex sections 441, which are portions of the metallic developing roller 44, are exposed to the surface 22*a* of the photosensitive member 22 within the developing gap DG, and discharge occurs in the developing gap DG depending upon which one of the developing bias Vb and the surface potential Vs of the photosensitive member is larger than the other.

Reduction of the developing bias Vb, and more particularly, its peak-to-peak voltage Vpp is effective for prevention of discharge. However, a lower developing bias makes it harder for toner to jump across the developing gap DG, and accordingly, the density, the quality and the like of an image are reduced. Other method to prevent discharge is to cover the entire surface of the developing roller 44 with toner T. Specifically, coating of the surface of the metallic developing roller 44 with toner which is an insulator makes it possible to increase the discharge inception voltage and to suppress discharge within the developing gap DG.

As described above, it is desirable that the convex sections 441 do not carry toner to ensure a favorable toner layer carried on the developing roller 44. On the other hand, there is a contradicting demand that the convex sections 441 as well should carry toner for prevention of discharge. These demands however can be satisfied simultaneously. It is within the restriction nip that the convex sections 441 should not carry toner. Meanwhile, it is within the developing gap DG which is located on the downstream side to the restriction nip in the rotation direction D4 of the developing roller 44 that the convex sections 441 should carry toner.

Hence, after the convex sections 441 move past the restriction nip without carrying toner, toner may be made adhere to the convex sections 441 to coat the convex sections 441 before the convex sections 441 arrive at the developing gap DG. Further, for the purpose of maintaining a transported amount, a charge level and the like of toner restricted by the restriction blade 46, it is desirable that toner which is made adhere to the convex sections 441 is toner carried by the surface of the developing roller 44 which has moved past the restriction nip, namely, toner carried by the concave section 442. In this embodiment, toner carried by the concave section 442 which has moved past the restriction nip is made move to the convex sections 441 in the following manner.

Figure 6A:
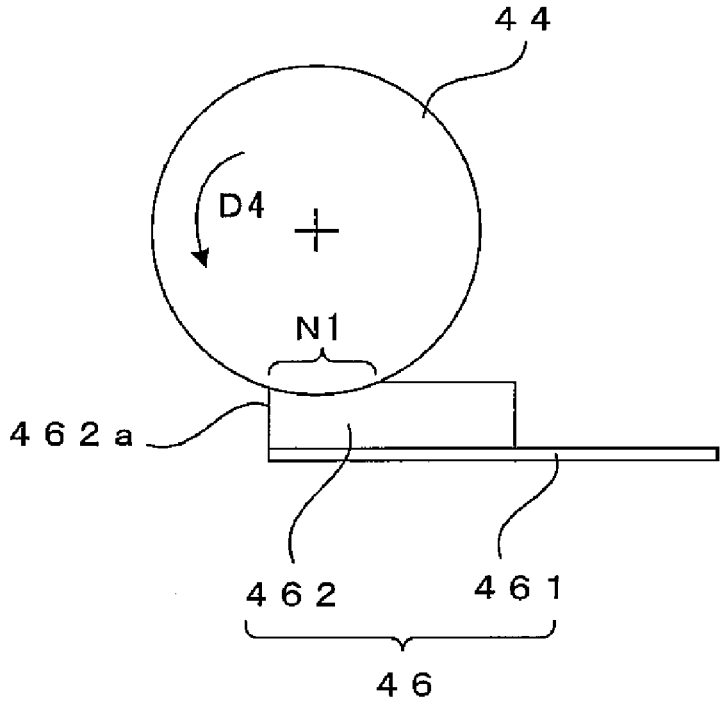
FIGS. 6A and 6B are diagrams showing a condition of the developing roller and the restriction blade abutting on each other.
Figure 6B:
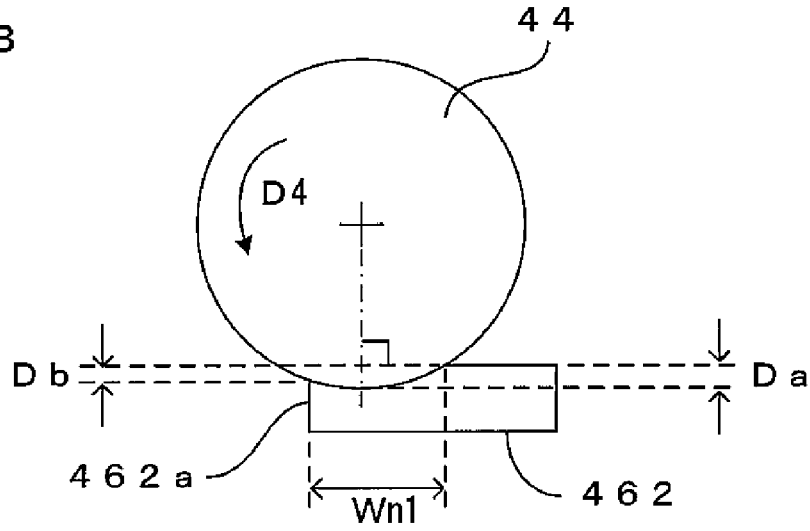

FIGS. 6A and 6B are diagrams showing a condition of the developing roller and the restriction blade abutting on each other. In this embodiment, as shown in FIG. 6A, the restriction blade 46 abuts on the surface of the developing roller 44 in a direction against the rotation direction D4 of the developing roller 44. The elastic member 462 at the tip end of the restriction blade 46 gets pressed by the surface of the developing roller 44 and partially and elastically deformed, whereby a restriction nip N1 is formed in which the surface of the developing roller 44 contacts the elastic member 462. Further, an upper edge of an upstream-side end 462*a* of the elastic member 462 in the rotation direction D4 of the developing roller 44 is within the restriction nip N1, and toner is regulated by means of the edge restriction.

As shown in FIG. 6B, the upstream-side end 462*a* of the elastic member 462 is located on the upstream side in the rotation direction D4 of the developing roller 44 relative to a perpendicular from the rotation center of the developing roller 44 to the top surface of the elastic member 462. Hence, the deformation Db of the elastic member 462 owing to elastic deformation in the vicinity of the upstream-side end 462*a* is somewhat smaller than the maximum deformation Da of the elastic member 462 in the vicinity of the foot of the perpendicular. The elastic member 462, positioned like this, contacts the developing roller 44 in a wide area within the top surface of the elastic member 462, which makes a restriction nip width Wn1 relatively wide.

Figure 7:
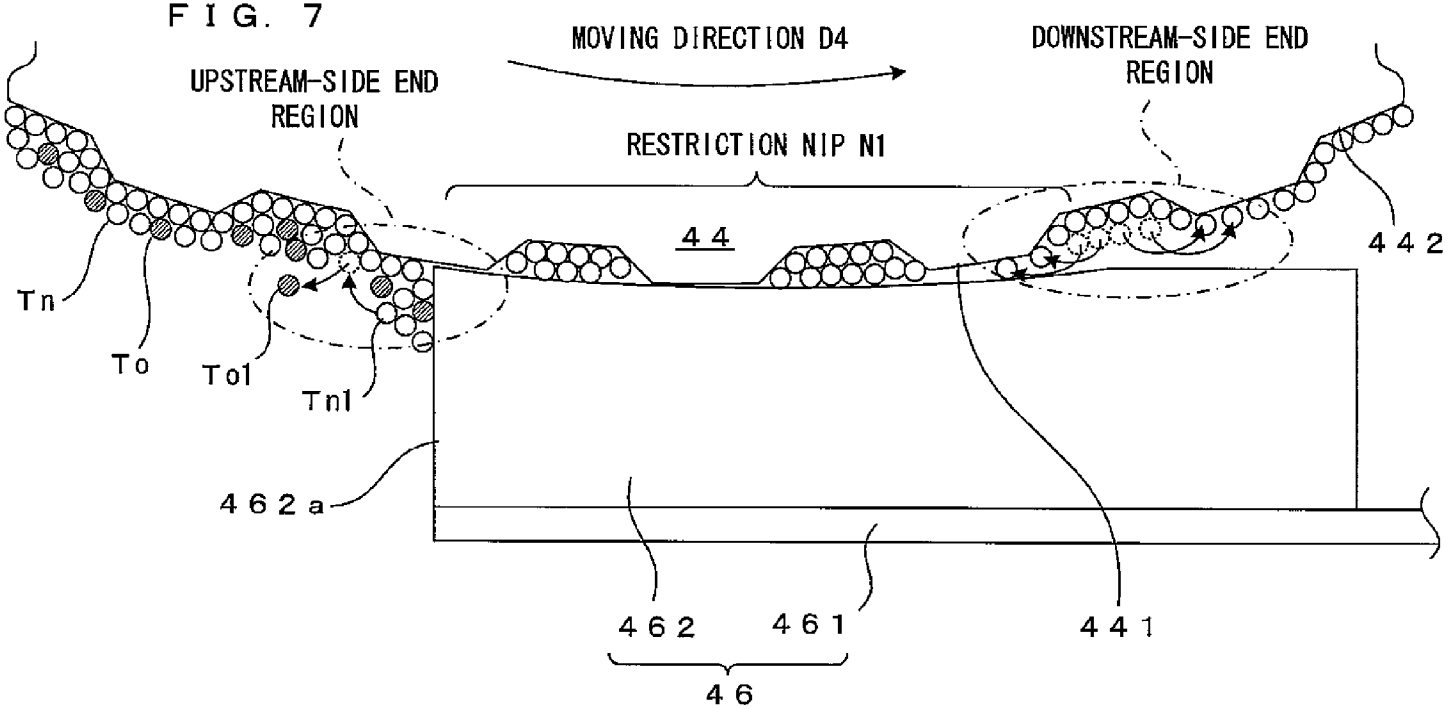
FIG. 7 is an enlarged schematic view of the restriction nip.

FIG. 7 is an enlarged schematic view of the restriction nip. In an upstream-side region to the restriction nip N1 in a moving direction D4 of the surface of the developing roller 44, a large amount of toner is accumulated right under the surface of the developing roller 44. This toner contains toner whose charge level is sufficient and toner having a low charge level due to degradation. In FIG. 7, favorably charged toner Tn is denoted at the white circles, whereas inadequately charged toner To is denoted at the shaded circles. While a layer of toner Tn whose charge level is high and whose electrostatic adhesion force to the developing roller 44 is strong is formed on the surface of the developing roller 44, a layer far from the surface of the developing roller 44 contains both favorably charged toner Tn and poorly charged toner To.

The elastic member 462 of the restriction blade 46 is pressed against the convex sections 441 of the developing roller 44. Hence, in an upstream-side end region of the restriction nip N1 in the moving direction D4 of the surface of the developing roller 44, the upstream-side end 462*a* of the elastic member 462 scrapes off toner on the convex sections 441. On the other hand, toner entered into inside the concave section 442, not contacting the elastic member 462, will not get scraped off. In addition, since the upstream-side end 462*a* of the elastic member 462 is approximately perpendicular to the surface of the developing roller 44, toner thus scraped off stays near the upstream-side end region of the restriction nip N1 without the toner on the convex sections 441 getting pushed into the restriction nip N1 or scraped toner getting pushed away from the surface of the developing roller 44.

The toner thus scraped off from the convex sections 441 contains both favorably charged toner Tn and poorly charged toner To, and toner removed from near the surfaces of the convex sections 441 has a particularly high charge level. This is because toner which used to adhere to the surfaces of the convex sections 441 is mostly toner having a high charge level from the beginning, and because strong electrostatic force which attracts this toner toward the developing roller 44 acts upon this toner since the charge level of this toner increases due to friction contact with the restriction blade 46 during removal from the convex sections 441 and rolling. Hence, of toner scraped off by the elastic member 462, toner Tn1 having a high charge level flips toner To1 which is near the surface of the developing roller 44 and has a low charge level. In short, in the upstream-side end region of the restriction nip N1, toner To having a low charge level is gradually replaced with toner Tn1 having a high charge level and is driven away to behind. As a result, within the restriction nip N1 and on the downstream side to the restriction nip N1 in the rotation direction D4 of the developing roller, the concave section 442 alone carries toner, whereby the proportion of toner having a low charge level within the toner carried by the concave section 442 becomes extremely low and a toner layer is formed principally by toner having a high charge level.

On the other hand, on the rear side to the restriction nip N1, that is, in the downstream-side end region in the moving direction D4 of the surface of the developing roller 44, the elastic member 462 which used to abut on the convex sections 441 of the developing roller 44 gradually becomes separated from the convex sections 441. This liberates toner which was trapped inside the concave section 442 whose openings were closed by the elastic member 462 within the restriction nip N1 to move more freely. Toner not directly contacting the surface of the developing roller 44 in particular is under weak force which attracts it toward the developing roller 44 and can therefore easily move. In contrast, toner is under powerful attraction force at the convex sections 441 whose metallic surfaces are exposed. In consequence, toner at the concave section 442 partially moves toward and adheres to the convex sections 441 as denoted at the arrows in FIG. 7. The convex sections 441 are thus covered with a part of toner which is carried by the concave section 442 and fulfills a discharge prevention function in the developing gap DG. Particularly, this effect is remarkable when toner whose degree of circularity and fluidity are high is used. According to the experiments by the inventor of the invention, an excellent result was attained when toner whose degree of circularity was 0.94 or more was used.

Next, description is made on the abutting part at which the developing roller 44 and the seal member 47 abut on each other. In this embodiment, as described above, after the toner on the convex sections 441 is removed in the restriction nip N1, the convex sections 441 carry the toner again at a place rearward of the restriction nip N1 and forward of the developing gap DG.

Figure 8A:
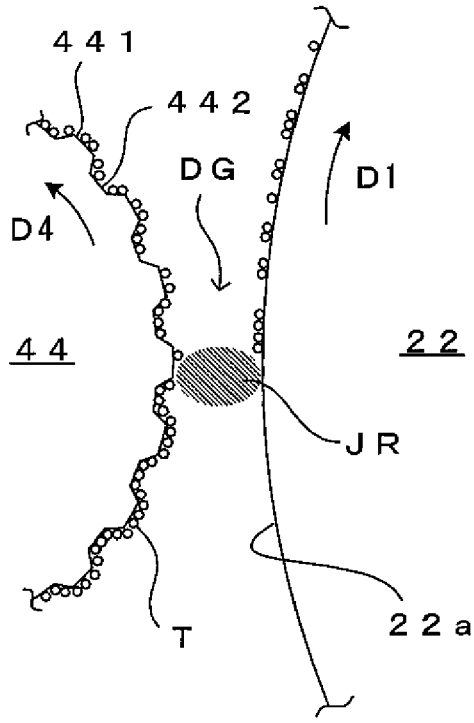
FIGS. 8A and 8B are diagrams showing surface conditions of the developing roller at places forward and rearward of the developing gap.
Figure 8B:
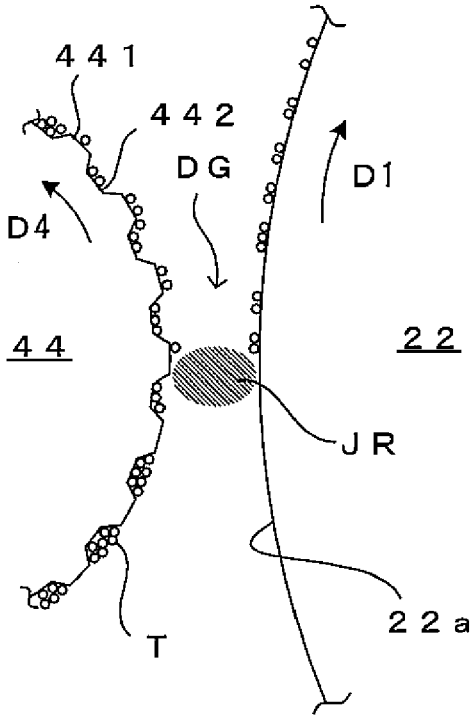

FIGS. 8A and 8B are diagrams showing surface conditions of the developing roller at places forward and rearward of the developing gap. In this embodiment, as shown in FIG. 8A, the toner T adheres to both the convex sections 441 and the concave section 442 on the surface of the developing roller 44 at the upstream side of the developing gap DG. The toner at the developing gap DG jumps from the surface of the developing roller 44 by the action of the developing bias so that a jumping region JR in which a large quantity of toner jump is formed between the developing roller 44 and the photosensitive member 22. A voltage having an alternating current component as shown in FIG. 4B is applied as the developing bias voltage Vb, and hence, the jumping toner reciprocates between the developing roller 44 and the photosensitive member 22 in the jumping region JR.

Some of the toner is transferred to a photosensitive member surface 22*a* in the jumping region JR, whereby the electrostatic latent image on the photosensitive member 22 is developed with the toner. Toner that has not been transferred to the photosensitive member surface 22*a* returns to the surface of the developing roller 44. It is noted here that the toner that has jumped in the jumping region JR and returns to the surface of the developing roller 44 may adhere to both the convex sections 441 and the concave section 442 of the developing roller 44. Therefore, at the downstream side to the jumping region JR in the rotation direction D4 of the developing roller 44, the toner adheres to the convex sections 441 as well. The same also holds for a case where the restriction nip permits the toner adhesion to the convex sections 441.

Further, the same also holds for a case where the convex sections 441 with no toner carried thereon are moved to the developing gap DG as shown in FIG. 8B. This is because even if the toner is carried only by the concave section 442 to the developing gap DG, all the toner once jumped in the jumping region JR do not return to the concave section 442 when returning back to the developing roller 44. That is, the toner that has jumped becomes adherent to the convex sections 441 with a certain probability. Hence, the toner also adheres to the convex sections 441 at the downstream to the developing gap DG in the end.

Even in an image forming apparatus of contact development system in which development is performed in a condition that the developing roller 44 and the photosensitive member 22 are in contact with each other, after the result of the toner being transferred between these members at a development nip where these members are in contact, the toner may naturally remain on the convex sections 441. Therefore, the following discussion holds for both the non-contact development system illustrated by the embodiment hereof and the contact development system.

Figure 9A:
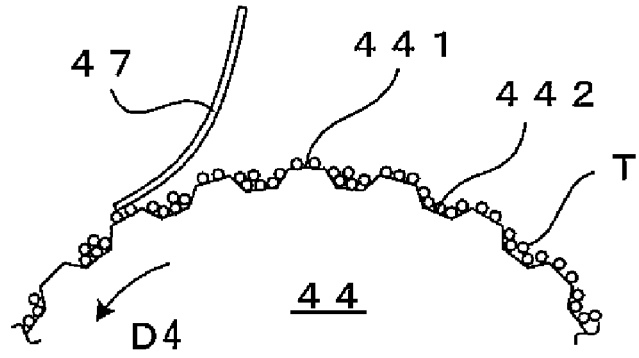
FIGS. 9A to 9C are diagrams showing an abutting condition of the developing roller and the seal member.
Figure 9B:
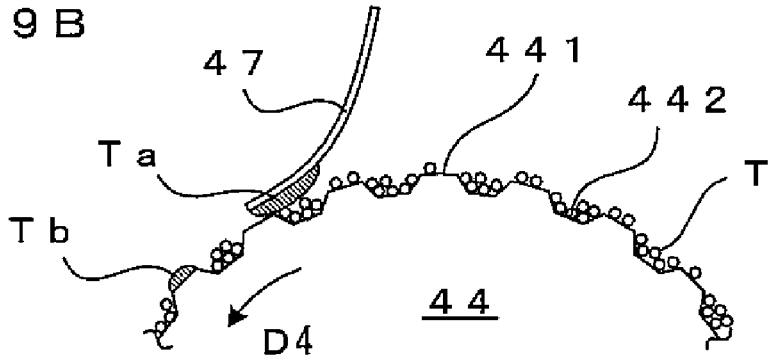
Figure 9C:
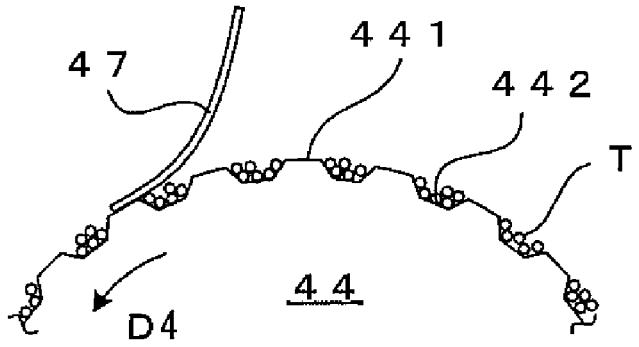

FIGS. 9A to 9C are diagrams showing an abutting condition of the developing roller and the seal member. When the convex sections 441 with the adherent toner T thereon are moved to the abutting part at which the convex sections 441 abut on the seal member 47 as shown in FIG. 9A, the toner T is sandwiched between the surface of the developing roller 44 and the seal member 47 to be subjected to a strong pressure.

Consequently, the toner may be firmly pressed to be fixed onto the seal member 47 and the developing roller 44 or the toner may clump together to form agglomerate. FIG. 9B shows a toner agglomerate Ta which is fixed to the surface of the seal member 47 and a toner agglomerate Tb which is fixed to one of the convex sections 441 of the developing roller 44. The toner thus fixed to the seal member 47 and the convex sections 441 may induce anew the formation of toner agglomerate, resulting in the further growth of toner agglomerate. In addition, an additive, wax and the like, which are added to the toner, may fall off from the toner core particles due to friction contact and may clump together to form an agglomerate, which may be fixed to the seal member 47 and the like.

There is a possibility that such toner agglomerates and the like may be caught between the developing roller 44 and the seal member 47 to produce a clearance therebetween, through which the toner may leak out of the developer. Further, the toner fixed to the developing roller 44 may induce a filming, which leads to an image defect. Furthermore, when the toner agglomerate fixed to the seal member 47 or the like is separated therefrom and falls into the housing 41, the problems that the toner agglomerate may form larger toner agglomerate in the housing or may become fixed to the restriction blade 46 arise.

In order to obviate these problems, it is desirable that the convex sections 441 of the developing roller 44 abut on the seal member 47 with no toner carried thereon as shown in FIG. 9C. It is noted that the toner carried by the concave section 442 does not receive a strong pressure from the seal member 47.

However, when the toner jumps at the developing gap DG, some of the toner inevitably becomes adherent to the convex sections 441 at the downstream side to the developing gap DG as described above. The application of the developing bias voltage to the developing roller with no toner carried on the convex sections thereof leads to an increased risk of discharge in the developing gap DG as described earlier. Consequently, in this embodiment, the toner removal operation is performed independently of the operation for forming the toner image by developing the electrostatic latent image (image forming operation). In the toner removal operation, the developing roller 44 with no toner carried on the convex sections 441 thereof is rotated so that the exposed convex sections 441 make a friction contact with the surface of the seal member 47 to scrape off the adherent toner.

Figure 10:
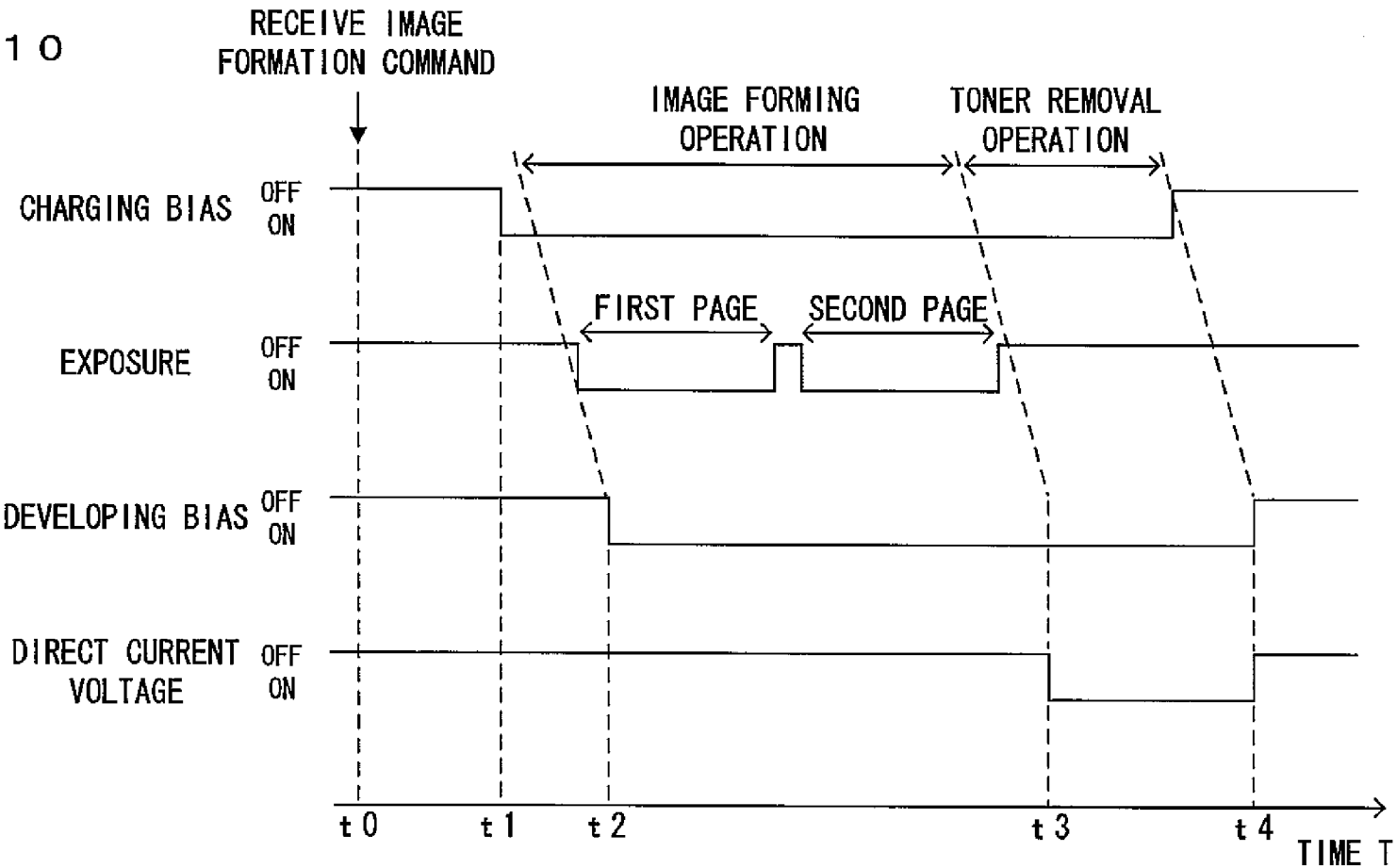
FIG. 10 is a timing chart showing the flow of a process including the image forming operation and the toner removal operation in this embodiment.
Figure 11A:
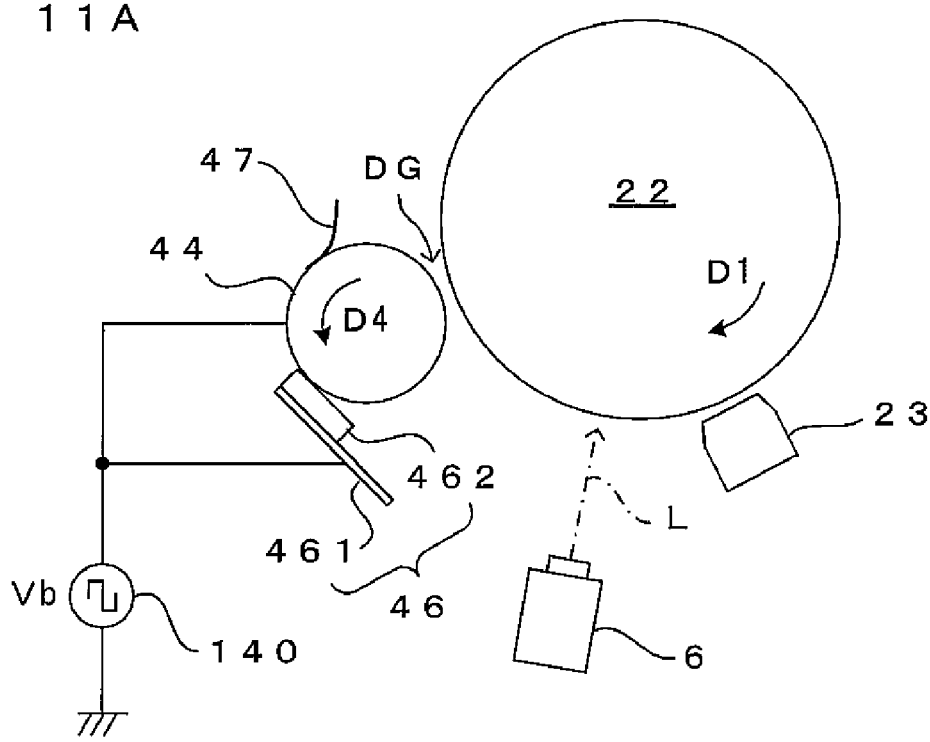
FIGS. 11A and 11B are diagrams schematically showing the electric potentials of the respective parts in the first embodiment.
Figure 11B:
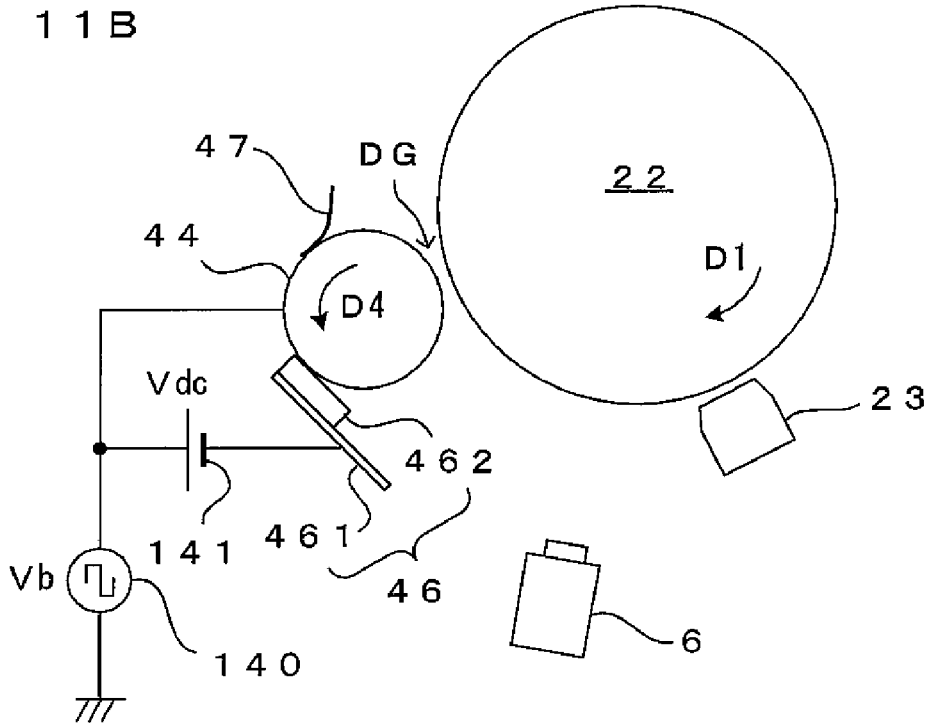

FIG. 10 is a timing chart showing the flow of a process including the image forming operation and the toner removal operation in this embodiment. FIGS. 11A and 11B are diagrams schematically showing the electric potentials of the respective parts in the first embodiment. When an image forming command is given from the external apparatus such as the host computer at a time t0, the CPU 101, in response to this command, controls the individual parts of the engine EG to perform the image forming operation and the toner removal operation. First, the charging bias to be applied to the charger unit 23 is turned on at a time t1 for charging the photosensitive member 22 to a predetermined surface potential. Then, the charged surface of the photosensitive member 22 is exposed by the light beam L from the exposure unit 6 whereby an electrostatic latent image corresponding to the image forming command is formed. In FIG. 10, a case where two page images are formed in succession is illustrated.

The application of the developing bias voltage is started at a time t2 which is a little before a leading end of the electrostatic latent image reaches the developing gap DG. At this time, the developing bias voltage Vb is applied not only to the developing roller 44 but also to the restriction blade 46 as shown in FIG. 11A. Thus, the electric potentials of the surface of the developing roller 44 and the elastic member 462 are equalized. With this structure, an electric field of the bias voltage is not formed at the concave section 442 in the vicinity of the restriction nip N1. Hence, the toner easily transfers from the concave section 442 to the convex sections 441 at the area rearward of the restriction nip, and accordingly, an effect to prevent the discharge is increased.

As described above, it is unavoidable that the toner also becomes adherent to the convex sections 441 at the downstream side to the developing gap DG while the development is performed at the developing gap DG by applying the developing bias voltage Vb to the developing roller 44. There is a possibility that such toner may become adherent to the seal member 47. Therefore, at a time t3 when the electrostatic latent images corresponding to the two page images pass through the developing gap DG and the development of the images are completed, a direct-current potential difference Vdc is provided between the developing roller 44 and the restriction blade 46 as shown in FIG. 11B, and this state is maintained for a predetermined length of time until a time t4. Specifically, the embodiment is provided with a direct-current power source 141 which outputs the direct current voltage Vdc as needed. The magnitude of the direct current voltage Vdc may be about 50 V for example. It is structured that the restriction blade 46 has a lower direct current potential. It is noted however that in a case where the toner is positively-charged, it is structured that the restriction blade 46 has a higher potential to the contrary.

It is noted here that an alternating current voltage component need not necessarily be applied to the restriction blade 46 because the purpose of applying the voltage is to set the direct current potential of the restriction blade 46 relative to that of the developing roller 44 in the above-described manner. Therefore, instead of applying the voltage generated by superimposing the direct current voltage Vdc upon the developing bias voltage Vb as described above, a direct current voltage (Vave+Vdc), for example, may be applied to the restriction blade 46. Further, the photosensitive member 22 may preferably be in a state where the photosensitive member 22 is subjected to the charging by the charger unit 23 but not subjected to the exposure by the exposure unit 6. In this state, the surface potential of the photosensitive member 22 is maintained at a uniform charging potential Vo as shown in FIG. 4B. Hence, the toner hardly moves from the developing roller 44 to the photosensitive member 22. This permits the toner on the developing roller 44 to be collected in the housing 41, which makes it possible to reduce unwanted toner consumption after the end of image formation.

Thus, the polarity of the direct current voltage of the restriction blade 46 relative to the developing roller 44 is the same as that of the charged toner. Hence, the restriction blade 46 acts to repel the toner in the housing 41. Accordingly, in the vicinity of the restriction nip, an electric field is formed so as to press the toner carried by the concave section 442 toward the surface of the developing roller 44. Therefore, the toner is less prone to transfer from the concave section 442 to the convex sections 441 at the area rearward of the restriction nip. As a result, it is possible to bring the convex sections 441 into direct contact with the seal member 47 in a condition that the convex sections 441 do not carry toner as shown in FIG. 9C. Therefore, it is possible to scrape off the toner adherent to the surface of the seal member 47 by the convex sections 441 and to collect it in the housing 41 by rotating the developing roller 44 for a certain period of time with this condition maintained.

Specifically, in this embodiment, the operation of rotating the developing roller 44 while applying an electric potential to the restriction blade 46 lower than that of the developing roller 44 after the image forming operation is completed acts as the toner removal operation of scraping off the toner adherent to the seal member 47. It is thus possible to prevent toner from fixing to the seal member 47 which results from the continuous adhesion of the toner to the seal member 47. Therefore, according to this embodiment, it is possible to obviate the problems that the toner fixed to the seal member 47 adheres to the developing roller 44 to cause filming, and that the toner agglomerate enters into the housing 41. It is particularly effective to perform the toner removal operation immediately after the image forming operation because the toner which has become adherent to the seal member 47 during the image forming operation is not left as it is but can be removed immediately after the adhesion.

In the toner removal operation, the convex sections 441 make a friction contact with the seal member 47 to scrape off the adherent toner. It is preferable for this purpose that toner is not adhered to the convex sections 441 and that the surfaces thereof are exposed. However, the embodiment does not totally inhibit the toner adhesion to the convex sections 441. According to the experiments performed by the inventor, when a half or more than a half of the top surface of the convex section is exposed, the effect of scraping off the toner from the seal member 47 is attained. Hence, it is preferable that a coverage ratio of the convex section is equal to or less than 50% in the toner removal operation. Here, a ratio of an area of a region covered with the toner to the entire area of the top surface of the convex section 441 is defined as the "coverage ratio of the convex section".

Figure 12:
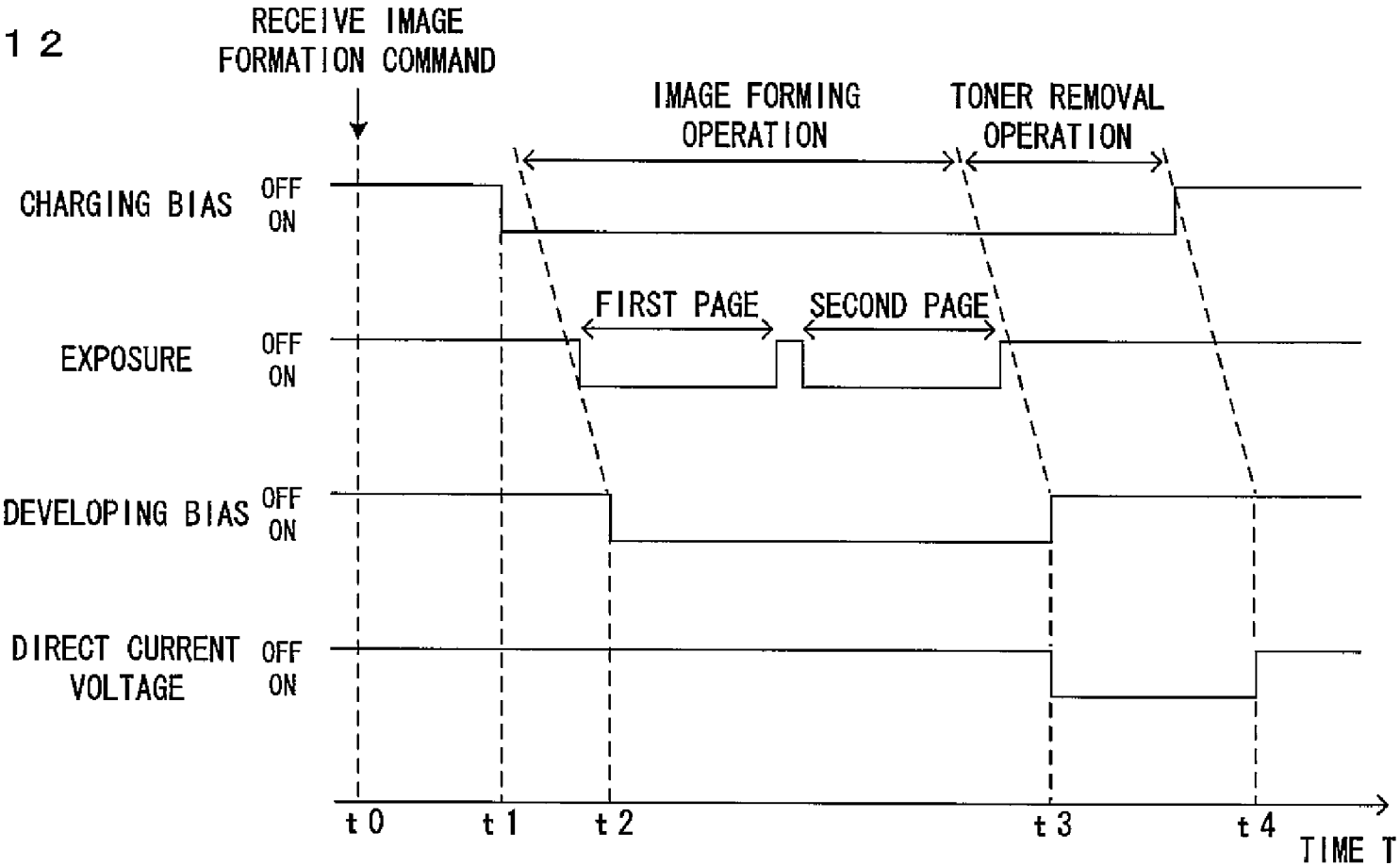
FIG. 12 is a timing chart showing the flow of a process including the image forming operation and the toner removal operation according to a second embodiment.
Figure 13:
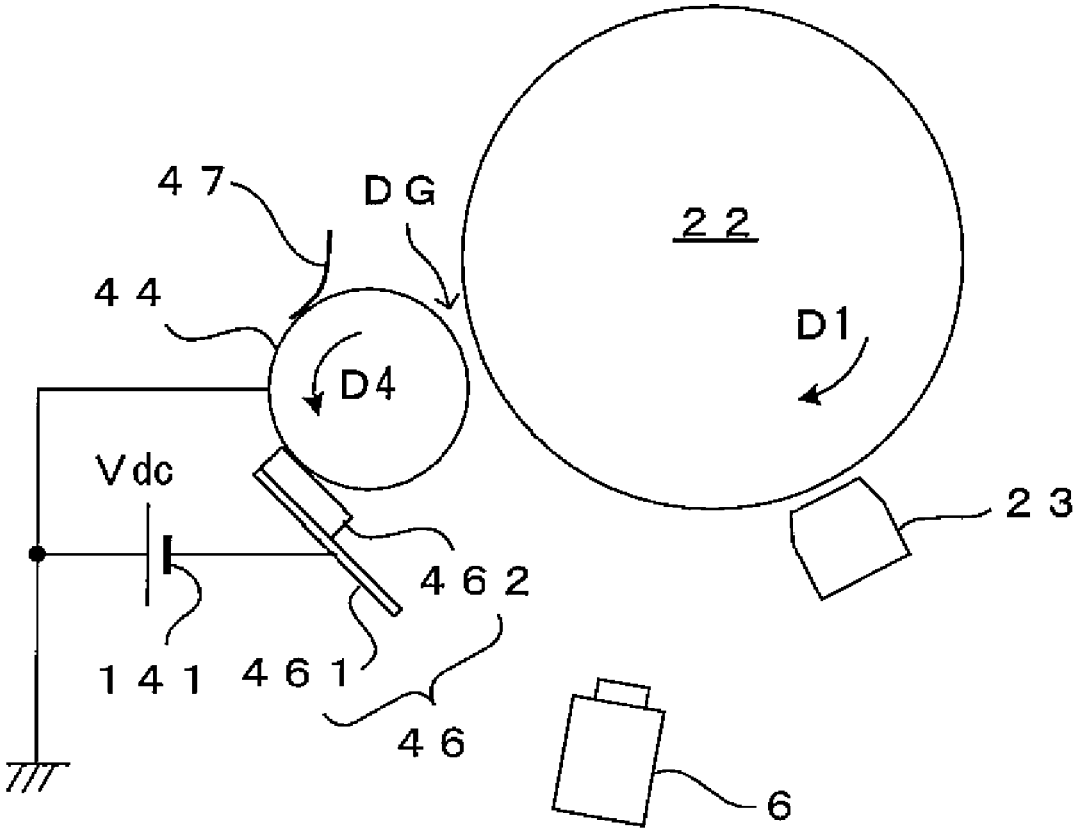
FIG. 13 is a schematic diagram showing the electric potentials of the respective parts of the second embodiment.

FIG. 12 is a timing chart showing the flow of a process including the image forming operation and the toner removal operation according to a second embodiment. FIG. 13 is a schematic diagram showing the electric potentials of the respective parts of the second embodiment. As shown in FIGS. 12 and 13, the operations of the second embodiment differ from those of the first embodiment in that the developing bias is turned off to maintain the developing roller 44 at the ground potential (0 V), during a time period between time t3 and time t4 which corresponds to the toner removal operation. Except for this, the second embodiment is arranged and operates the same way as the first embodiment.

With this operation, during the toner removal operation, the electric field at the developing gap DG is so weak that the toner does not jump. Hence, this operation, together with the application of a negative electric potential to the restriction blade 46, makes it possible to extremely reduce the amount of toner carried on the convex sections 441 at the downstream side to the developing gap DG in the rotation direction D4 of the developing roller 44. As a result, the convex sections 441 can achieve the maximum effect to scrape off the toner from the seal member 47.

In these embodiments, it is desirable that the elastic member 462 disposed in the restriction blade 46 is conductive. For instance, carbon dispersed in urethane rubber whose hardness is roughly 70 degrees measured in accordance with JIS (Japanese Industrial Standards)-A to achieve the specific resistance of approximately $10^6$ Ω·cm may be used as the elastic member 462. Although the specific resistance of the elastic member 462 is not limited to the above value, a favorable result is obtained when the specific resistance is $10^8$ Ω·cm or lower according to experiments by the inventor of the invention. Further, connection of a plate-like member 461 made of a metal plate with the direct-current power source 141 makes it possible to provide the same electric potential to the entire elastic member 462.

While the particle diameter of the toner used in the above embodiments is not particularly limited, a significant effect can be obtained particularly when a toner of a small particle diameter is used. The term "toner of a small particle diameter" as used herein means one having a volume average particle diameter of about 5 μm or less, for example. As the particle diameter of toner decreases, van der Waals' force which acts upon toner increases, and this tendency is particularly notable when the particle diameter of toner is 5 μm or less. Such toner has a very high possibility of adhering to the developing roller 44 and the seal member 47 or of clumping together of toner with each other due to the van der Waals' force. In the apparatus using such toner, execution of the above-described toner removal operation makes it possible to effectively prevent the problems such as the toner fixing to the seal member 47 or to the developing roller 44, and the image defects resulting from the toner fixing.

As described above, in the above embodiments, the photosensitive member 22 and the developing roller 44 function as an "image carrier" and a "toner carrier roller" of the invention, respectively. The bias power source 140, the housing 41 and the seal member 47 respectively fraction as a "bias applier", a "toner collector" and a "seal member" of the invention. The restriction blade 46 functions as a "restrictor" of the invention. The elastic member 462 is equivalent to an "elastic abutting member" of the invention. In these embodiments, the engine controller 10 or particularly the CPU 101 thereof functions as a "controller" of the invention.

It should be noted that the invention is not limited to the embodiments above, but may be modified in various manners in addition to the embodiments above, to the extent not deviating from the object of the invention. For example, although the convex sections 441 of the developing roller 44 are lozenge-shaped in the above embodiments, this is not limiting. The convex sections may be shaped differently such as circles and triangles for instance.

In the above embodiments, each image forming operation is followed by the toner removal operation. However, the timing for the execution of the toner removal operation is not limited to this. For instance, the toner removal operation may be performed just before the image forming operation is performed. This permits the toner adherent to the seal member 47 to be previously removed before the image forming operation is started. It is therefore possible to prevent the toner from forming a larger toner agglomerate with such an adherent toner as a core during the image forming operation. Further, it is more effective to perform the toner removal operation before and after the image forming operation for instance.

Further, the toner removal operation need not necessarily be performed each time the image forming operation is performed for example. The toner removal operation may be performed when a parameter indicative of the quantity of toner adherent to the seal member 47 reaches a given numerical value, the parameter including the number of formed images, the number of rotation of the developing roller and the rotation time of the developing roller, for instance.

In the above embodiments, the toner removal operation is performed on one developer immediately after the image forming operation. The toner removal effect is high with such a construction. However, in a case where a large number of color images are successively formed while switching the four developers for example, the throughput of image formation may be decreased because the developers are switched after the toner removal operation is performed. To avoid this problem, the toner removal operation may be performed after the image formation of the last page in a series of image forming job is finished for example. Alternatively, a sequence may be separately provided which performs only the toner removal operation after the image forming job is finished. With such a construction, the toner removal operation can be performed without affecting the throughput.

Although the developing roller 44 is metallic cylinder in the above embodiments, the invention is also applicable to an apparatus comprising a developing roller made of other material. However, experiments performed by the inventor of the invention have identified that the effect of applying the invention was remarkable when a developing roller whose surface is made of a conductive material such as a metallic developing roller and a developing roller made of non-metal with metal-plating thereon is used. In this respect, the invention is also effective to an apparatus comprising a developing roller which is made conductive by dispersing a conductive material such as carbon black and metallic fine powder in a cylinder made of rubber, resin or the like for instance.

Further, although the restriction blade 46 is prepared by attaching the elastic member 462 made of resin to a plate-like member 461 made of metal in the embodiments above, this structure is not limiting. The restriction blade may be a plate of metal alone or a metal plate coated with resin, for example.

The image forming apparatus in each of the above embodiments is a color image forming apparatus in which the developers 4K, . . . are attached to the rotary developer unit 4. However, the application of the invention is not limited to this as mentioned earlier. The invention is also applicable to a so-called tandem type color image forming apparatus in which a plurality of developers are arranged along an intermediate transfer belt, and to a monochromatic image forming apparatus which includes only one developer and forms a monochromatic image for example.

In an embodiment according to the invention, it is preferable that the quantity of toner on the convex sections is minimized because the toner carried on the convex sections induces anew the toner adhesion to the seal member and also decreases the toner scraping effect by the convex sections. A coverage ratio with toner of the surfaces of the convex sections, that is, a ratio of an area of a region covered with toner to the entire area of the top surfaces of the convex sections may preferably be equal to or less than 50%. Furthermore, the convex sections may also carry no toner thereon, that is, the coverage ratio may be 0%.

As for the above-described toner carrier roller, the convex sections may preferably be so constructed and arranged that top surfaces of the convex sections coincide with a part of a curved surface of a single cylinder That is, an enveloping surface constituted by the top surfaces of the plural convex sections may preferably define one cylindrical surface. Thus, the toner carrier roller may be regarded as a rotating cylinder in a macroscopic view. Hence, the abutting pressure on the seal member in the circumferential direction of the toner carrier roller can be constant.

There may be further provided a restrictor that abuts on the surface of the toner carrier roller at a place upstream to the opposed position facing the image carrier in the rotation direction of the toner carrier roller to restrict a thickness of the toner layer carried on the surface of the toner carrier roller, and removes toner on the convex sections when the toner removal operation is performed. When the developing bias is applied to the toner carrier roller to develop the electrostatic latent image, whether or not the convex sections carry the toner thereon is arbitrary. However, it is preferable that the restrictor removes the toner from the convex sections at least when the toner removal operation is performed. The restrictor for restricting the thickness of the toner layer is also used for removing the toner from the convex sections in the toner removal operation, and hence, it is not necessary to separately provide a construction for removing the toner from the convex sections.

Further, the controller may be adapted to provide, in performing the toner removal operation, an electric potential difference between the toner carrier roller and the restrictor so that a polarity of a direct current potential of the restrictor relative to the toner carrier roller is the same as that of the charged toner. With such a construction, an electric field is formed such that the restrictor acts to press the toner carried by the concave section onto the surface thereof. Therefore, the toner carried by the concave section is prevented from transferring to the convex sections.

In the arrangement in which a predetermined electric potential is applied to the restrictor, the restrictor may include an elastic abutting member which is made of an elastic material whose specific resistance is equal to or less than $10^8$ Ω·cm and is pressed against the surface of the toner carrier roller. With such a construction, the restrictor can more securely remove the toner from the convex sections.

The embodiment according to the invention is effective for both the contact development system in which the image carrier and the toner carrier roller abut on each other at the opposed position and the non-contact development system in which the image carrier and the toner carrier roller face each other across a predetermined gap therebetween. It is noted that the embodiment is particularly effective for a case where the developing bias voltage includes an alternating current component or a case where the toner carrier roller and the image carrier are arranged in non-contact with each other. With such arrangements, toner jumps across the gap at the opposed position of the toner carrier roller facing the image carrier. Hence, it is unavoidable that the convex sections abut on the seal member with the toner adherent to the convex sections during the development. Therefore, it is effective to perform the toner removal operation to prevent fixing of toner.

In this case, the controller may be adapted to control, in performing the toner removal operation, the bias applier so that an electric potential of the toner carrier roller is different from the developing bias voltage. The developing bias voltage applied to the toner carrier roller normally acts to promote transfer of toner from the toner carrier roller surface to the image carrier. When such an electric potential is applied to the toner carrier roller, there is a possibility that the toner once removed from the convex sections may become adherent thereto again. Therefore, it is desirable to apply a voltage to the toner carrier roller unequal to the developing bias voltage in the toner removal operation. More specifically, the bias applier may preferably apply such a voltage as to suppress transfer of toner from the toner carrier roller surface to prevent the re-adhesion of the toner to the convex sections.

For example, the controller may be adapted to control, in performing the toner removal operation, the bias applier to form an electric field between the image carrier and the toner carrier roller weaker than the electric field formed therebetween when the developing bias voltage is applied to the toner carrier roller. The charged toner on the toner carrier roller moves easily in the electric field. However, the movement of toner can be suppressed by weakening the electric field.

In another specific embodiment, the controller may be adapted to control, in performing the toner removal operation, the bias applier to set the toner carrier roller to a ground potential. The transfer of the toner carried on the toner carrier roller can be almost completely suppressed by applying to the toner carrier roller a bias voltage equal to the ground potential or zero.

For example, the controller may be adapted to selectively perform the toner removal operation and an image forming operation by controlling various parts of the apparatus, the image forming operation forming an electrostatic latent image on the image carrier and applying the developing bias voltage to the toner carrier roller to develop the electrostatic latent image with the toner to form a toner image, and the controller may be adapted to perform the toner removal operation after the image forming operation is performed.

At which timing the toner removal operation is performed is arbitrary. The toner removal operation may be performed just before and/or after the image forming operation or between the image forming operations. However, when the image forming operation is performed, it is inevitable that the toner transfers to the convex sections, and consequently, the toner adheres to the seal member Meanwhile, the toner adherent to the seal member can be removed by performing the toner removal operation. Hence, it is most effective to perform the toner removal operation after the image forming operation is finished. Particularly when the toner removal operation is performed just after the image forming operation, the toner adherent to the seal member can be immediately removed. Hence, the agglomeration or the fixing of toner can be prevented effectively.

In this case, when the surface of the toner carrier roller is conductive, it is preferable that the controller is adapted to apply, in performing the image forming operation, an electric potential to the restrictor whose level is equal to that of the toner carrier roller. The experiments performed by the inventor have revealed that this construction is effective to suppress the electric discharge which can occur at the opposed position of the toner carrier roller facing the image carrier between the exposed area of the toner carrier roller and the image carrier. It can be contemplated that this is because the restrictor and the toner carrier roller have no potential difference therebetween at the restriction nip defined by the restrictor and the toner carrier roller abutting on each other, and hence, a strong electric field is not exerted on the carried toner so that at the downstream side to the restriction nip in the rotation direction of the toner carrier roller, a part of the toner carried by the concave section transfers to the convex sections to cover the convex sections.

On the other hand, carrying toner on the convex sections easily causes the toner adhesion to the seal member. Therefore, when the image forming operation and the toner removal operation are performed in combination, the prevention of electric discharge and the prevention of toner adhesion to the seal member can be both accomplished.

Further, an embodiment according to the invention offers a particularly notable effect in a case where a volume average particle diameter of the toner is equal to or less than 5 μm. Since the toner having the small particle diameter is strongly affected by the van der Waals' force, the toner is prone to form agglomerate or to cause fixing to the seal member. By applying the embodiment to the apparatus using such a toner, the toner is prevented from fixing to the seal member or from forming agglomerate. While the toner having a low melting point is also prone to cause fixing to the seal member or filming, the embodiment may preferably be applied to the apparatus using such a toner.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

an image carrier that carries an electrostatic latent image;

a toner carrier roller that is provided, on a surface thereof, with a plurality of convex sections and a concave section which surrounds the convex sections, is shaped approximately like a cylinder, is arranged opposed to the image carrier, and rotates while carrying a toner layer of charged toner on the surface thereof;

a bias applier that applies a developing bias voltage to the toner carrier roller;

a housing that collects the toner carried on the surface of the toner carrier roller at a place downstream to an opposed position facing the image carrier in a rotation direction of the toner carrier roller;

a seal member that is interposed between the toner carrier roller and the housing, and abuts on the surface of the toner carrier roller to prevent leakage of toner from the housing;

a controller that is adapted to perform a toner removal operation which removes toner adherent to the seal member by rotating the toner carrier roller while the toner carrier roller abuts on the seal member, in a condition that at least a part of respective surfaces of the convex sections do not carry toner so as to be exposed; and a restrictor that abuts on the surface of the toner carrier roller at a place upstream to the opposed position facing the image carrier in the rotation direction of the toner carrier roller to restrict a thickness of the toner layer carried on the surface of the toner carrier roller, and removes toner on the convex sections when the toner removal operation is performed, wherein the controller is adapted to provide, in performing the toner removal operation, an electric potential difference between the toner carrier roller and the restrictor so that a polarity of a direct current potential of the restrictor relative to the toner carrier roller is the same as that of the charged toner.

2. The image forming apparatus of claim 1, wherein the convex sections are so constructed and arranged that top surfaces of the convex sections coincide with a part of a curved surface of a single cylinder.

3. The image forming apparatus of claim 1, wherein the restrictor includes an elastic abutting member which is made of an elastic material whose specific resistance is equal to or less than $10^8$ Ω·cm and is pressed against the surface of the toner carrier roller.

4. The image forming apparatus of claim 1, wherein the bias applier applies the developing bias voltage including an alternating current component to the toner carrier roller.

5. The image forming apparatus of claim 1, wherein the toner carrier roller and the image carrier are arranged in non-contact with each other.

6. The image forming apparatus of claim 1, wherein the controller is adapted to control, in performing the toner removal operation, the voltage applied by the bias applier so that an electric potential of the toner carrier roller is different from the developing bias voltage, and so that an electric field is formed between the image carrier and the toner carrier roller that is weaker than an electric field formed therebetween when the developing bias voltage is applied to the toner carrier roller.

7. The image forming apparatus of claim 6, wherein the controller is adapted to control, in performing the toner removal operation, the bias applier to set the toner carrier roller to a ground potential.

8. The image forming apparatus of claim 1, wherein the controller is adapted to selectively perform the toner removal operation and an image forming operation by controlling various parts of the apparatus, the image forming operation forming an electrostatic latent image on the image carrier and applying the developing bias voltage to the toner carrier roller to develop the electrostatic latent image with the toner to form a toner image, and wherein the controller is adapted to perform the toner removal operation after the image forming operation is performed.

9. The image forming apparatus of claim 8, wherein the surface of the toner carrier roller is conductive, and wherein the controller is adapted to apply, in performing the image forming operation, an electric potential to the restrictor whose level is equal to that of the toner carrier roller.

10. The image forming apparatus of claim 1, wherein a volume average particle diameter of the toner is equal to or less than 5 μm.

11. An image forming method, comprising:

performing an image forming operation that includes:

rotating a toner carrier roller that is provided, on a surface thereof, with a plurality of convex sections and a concave section which surrounds the convex sections, is shaped approximately like a cylinder, and carries a toner layer of charged toner on the surface thereof to transport the toner layer to an opposed position facing an image carrier which carries an electrostatic latent image;

developing the electrostatic latent image with the toner; and collecting toner carried on the surface of the toner carrier roller by causing a seal member to abut on the surface of the toner carrier roller at a place downstream to the opposed position facing the image carrier in a rotation direction of the toner carrier roller, and performing a toner removal operation which removes toner adherent to the seal member by:

rotating the toner carrier roller while the toner carrier roller abuts on the seal member, in a condition that at least a part of the respective surfaces of the convex sections do not carry toner;

abutting a restrictor on the surface of the toner carrier roller at a place upstream to the opposed position facing the image carrier in the rotation direction of the toner carrier roller to restrict a thickness of the toner layer carried on the surface of the toner carrier roller and to remove toner on the convex section; and providing an electric potential difference between the toner carrier roller and the restrictor so that a polarity of a direct current potential of the restrictor relative to the toner carrier roller is the same as that of the charged toner, wherein the image forming operation and the toner removal operation are selectively performed.

* * * * *